US005474475A

United States Patent [19]

Yamaguchi

[11] Patent Number: 5,474,475

[45] Date of Patent: Dec. 12, 1995

[54] CONSTRUCTION FOR FIXING BUS BAR FOR MINIATURE FUSES TO ELECTRICAL CONNECTION BOX

[75] Inventor: Jun Yamaguchi, Yokkaichi, Japan

[73] Assignee: Sumitomo Wiring Systems, Ltd., Yokkaichi, Japan

[21] Appl. No.: 252,168

[22] Filed: May 31, 1994

[30] Foreign Application Priority Data

Jul. 7, 1993 [JP] Japan ..... 5-037183 U

[51] Int. Cl.[6] ..... H01R 25/16

[52] U.S. Cl. ..... 439/621; 439/212; 439/723

[58] Field of Search ..... 439/621, 622, 439/721, 723, 724, 212

[56] References Cited

U.S. PATENT DOCUMENTS

| | | | |
|---|---|---|---|
| 4,002,388 | 1/1977 | Menocal | 439/721 |
| 4,772,759 | 9/1988 | Roy et al. | 174/17 VA |
| 4,992,062 | 12/1991 | Nakayama et al. | 439/621 |
| 5,023,752 | 6/1991 | Detter et al. | 361/751 |
| 5,088,940 | 2/1992 | Saito | 439/621 |
| 5,160,274 | 11/1992 | Ozaki et al. | 439/724 |

FOREIGN PATENT DOCUMENTS

| | | |
|---|---|---|
| 0003289 | 8/1979 | European Pat. Off. . |
| 0097445 | 1/1984 | European Pat. Off. . |
| 0360241 | 11/1931 | United Kingdom . |
| 0696341 | 8/1953 | United Kingdom . |
| 1012748 | 12/1965 | United Kingdom . |
| 1106557 | 3/1968 | United Kingdom . |
| 2007145 | 5/1979 | United Kingdom . |
| 2223630 | 4/1990 | United Kingdom . |
| 9408375 | 4/1994 | WIPO . |

*Primary Examiner*—Carmen Paumen
*Attorney, Agent, or Firm*—Sandler, Greenblum & Bernstein

[57] ABSTRACT

A construction for fixing a bus bar for miniature fuses to an electrical connection box, in which the miniature fuses attached to the electrical connection box in parallel with each other at a short interval are connected to the bus bar accommodated in the electrical connection box, comprising: tabs which project from a base portion of the bus bar in parallel with each other at the short interval so as to be connected to the miniature fuses, respectively; a pair of extension portions which extend from opposite ends of the base portion of the bus bar beyond positions for providing the tabs on the bus bar, respectively; a pair of engageable portions which are provided on the extension portions, respectively; and a pair of mating engageable portions which are engageable with the engageable portions, respectively and are provided on the electrical connection box.

13 Claims, 5 Drawing Sheets

CONSTRUCTION FOR FIXING BUS BAR FOR MINIATURE FUSES TO ELECTRICAL CONNECTION BOX

BACKGROUND OF THE INVENTION

The present invention generally relates to a construction in which a bus bar for miniature fuses is fixed to an electrical connection box and more particularly, to a construction in which the bus bar connected to the miniature fuses attached to the electrical connection box in parallel with each other at a short interval can be securely fixed to the electrical connection box.

Conventionally, automotive fuses have been employed as fuses which are mounted on an electrical connection box so as to be connected to a bus bar. The automotive fuses are large in size and are attached to the electrical connection box at a large interval.

In a known arrangement of FIG. 1, a bus bar 1 is accommodated in an electrical connection box (not shown) so as to be connected to an automotive fuse 3 and tabs 1*b* project from a base portion 1*a* of the bus bar 1 at an interval identical with that for mounting the automotive fuses 3 on the electrical connection box. Thus, each tab 1*b* and a terminal portion 3*a* of each automotive fuse 3 are connected to each other through a relay terminal 2.

The bus bar 1 to be connected to the automotive fuses 3 is required to be preliminarily accommodated and fixed in the electrical connection box. To this end, a locking hole 1*c* is formed, between the tabs 1*b*, on the base portion 1*a* so as to receive a locking claw (not shown) projecting from the electrical connection box such that the bus bar 1 is secured to the electrical connection box.

In response to recent demand for a more compact and lighter electrical connection box, miniature fuses obtained by making the automotive fuses more compact have been proposed in place of the automotive fuses. If the miniature fuses can be attached to the electrical connection box at a small interval, the electrical connection box can be made more compact.

However, in this case, the tabs connected to the miniature fuses also should be formed on the bus bar at a short interval. Thus, such problems arise that it is extremely difficult to form the locking hole on the base portion between the tabs spaced the short interval from each other and bring the locking claw of the electrical connection box into engagement with the locking hole of the bus bar.

Furthermore, conventionally, the miniature fuses are more likely to be heated than the large automotive fuses. Therefore, if the miniature fuses are attached to the electrical connection box in the vicinity of the tabs, the electrical connection box is readily overheated.

SUMMARY OF THE INVENTION

Accordingly, an essential object of the present invention is to provide, with a view to eliminating the inconveniences inherent in the prior art, a construction in which a bus bar for miniature fuses is fixed to an electrical connection box.

In order to accomplish this object of the present invention, a construction for fixing a bus bar for miniature fuses to an electrical connection box, in which the miniature fuses attached to the electrical connection box in parallel with each other at a short interval are connected to the bus bar accommodated in the electrical connection box, according to the present invention comprises: tabs which project from a base portion of the bus bar in parallel with each other at the short interval so as to be connected to the miniature fuses, respectively; a pair of extension portions which extend from opposite ends of the base portion of the bus bar beyond positions for providing the tabs on the bus bar, respectively; a pair of engageable portions which are provided on the extension portions, respectively; and a pair of mating engageable portions which are engageable with the engageable portions, respectively and are provided on the electrical connection box.

It is preferable that each of the engageable portions of the bus bar is formed by an engageable hole and each of the mating engageable portions of the electrical connection box is formed by a boss. However, this arrangement may also be reversed, namely, each of the engageable portions of the bus bar is formed by the boss, while each of the mating engageable portions of the electrical connection box is formed by the engageable hole.

The extension portions of the bus bar extend from opposite ends of the base portion. At this time, it is preferable that the extension portions extend up to such positions as not to interfere with other components attached to inside of the electrical connection box and a distal end portion of each of the extension portions is bent into a bent portion such that each of the engageable portions is provided on the bent portion.

In the bus bar, the engageable portions are, respectively, provided on the extension portions extending from the opposite ends of the base portion of the bus bar and the engageable portions are provided on the extension portions, respectively. Therefore, the engageable portions can be formed on the bus bar easily and it is possible to bring the bus bar and the electrical connection box into engagement with each other easily.

Meanwhile, since the extension portions extend from the opposite ends of the base portion of the bus bar, the bus bar has a large area. Accordingly, a large quantity of electric current can be passed through the bus bar due to increase of area of the bus bar for allowing electric current to flow therethrough and overheating of the bus bar can be restrained.

Furthermore, in the bus bar, its positions for engagement with the electrical connection box, i.e., the extension portions, are spaced away from its positions for connection to miniature fuses, i.e., the tabs. Hence, even if the temperature of the miniature fuses rises, heat conduction from the miniature fuses to the electrical connection box via the bus bar can be restricted and thus, overheating of the electrical connection box can also be prevented.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
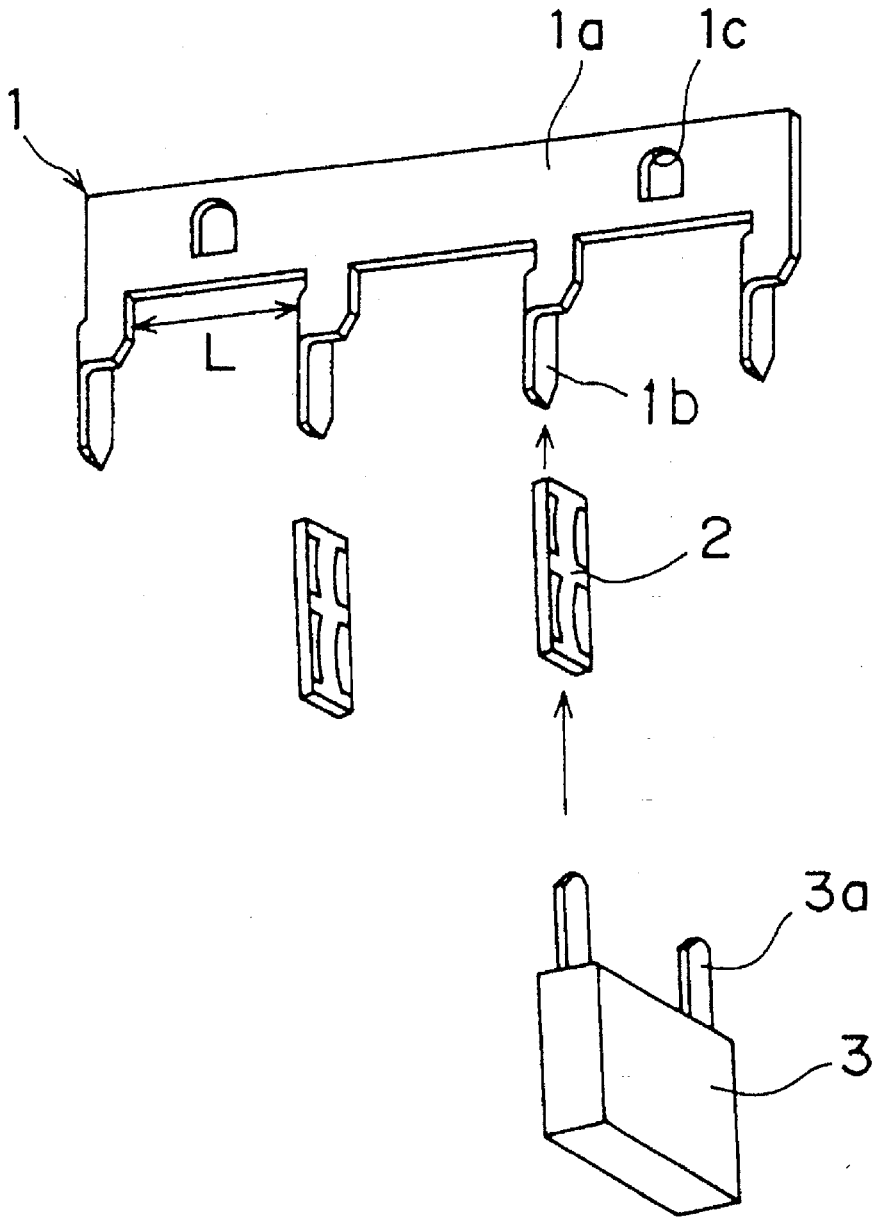
Fig 1 PRIOR ART
FIG. 1 is a perspective view of a prior art bus bar (referenced above)

Referring now to the drawings, there is shown in FIGS. 2 to 7, a construction K for fixing a bus bar 12 for miniature fuses 11 to an electrical connection box 10, according to one embodiment of the present invention. In the construction K, the miniature fuses 11 are mounted on the electrical connection box 10 so as to be arranged in parallel with each other at a short interval. The electrical connection box 10 is formed by a fusible link block. The bus bar 12 for the miniature fuses 11 is accommodated in and fixed to the electrical connection box 10 and the miniature fuses 11 are connected to the bus bar 12 so as to form a branch circuit.

Figure 2:
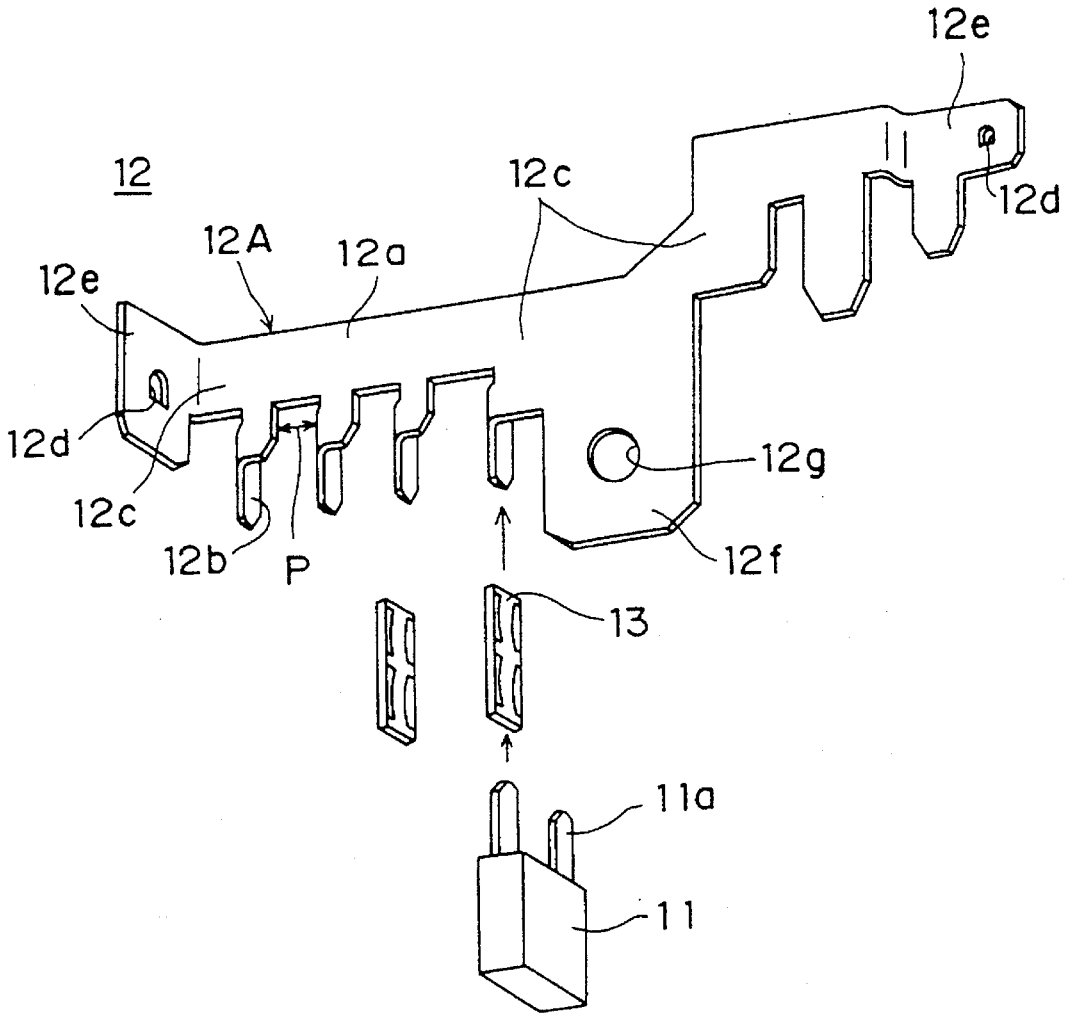
FIG. 2 is a perspective view of a bus bar for miniature fuses, employed in a construction for fixing the bus bar to an electrical connection box, according to the present invention.
Figure 3:
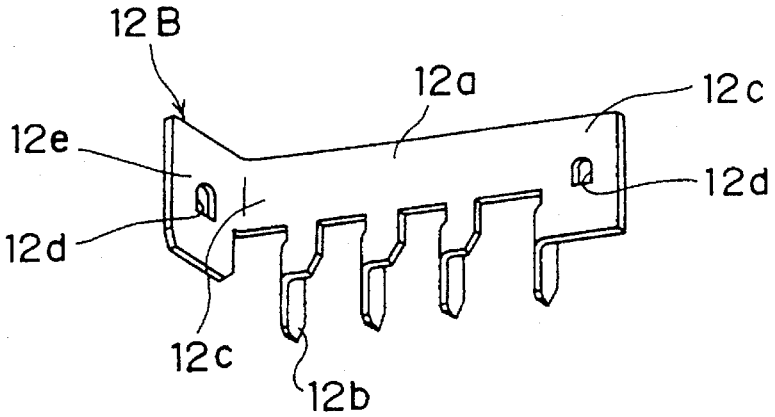
FIG. 3 is a perspective view of another bus bar for miniature fuses, employed in the construction of FIG. 2.

The bus bar 12 is obtained by blanking an electrically conductive metal plate and includes two kinds of bus bars 12A and 12B shown in FIGS. 2 and 3, respectively. In the bus bar 12, tabs 12*b* project downwardly from a lower end of a base portion 12*a* at a short interval P such that each of the tabs 12*b* is connected to each of two terminal plates 11*a* of each of the miniature fuses 11 through a relay terminal 13. Namely, the interval P of the tabs 12*b* corresponds to that of fuse receivers 10*a* of the electrical connection box 10, which will be described later, and is smaller than an interval L of a prior art bus bar 1 of FIG. 1.

In preferred embodiments, the base portion of the bus bar is disposed in one plane and the tabs have a first end secured to the base portion and s second end twisted out of the plane of the base portion.

Two extension portions 12*c* are, respectively, extended from the opposite tabs 12*b* of the base portion 12*a* up to such positions as not to interfere with other components attached to inside of the electrical connection box 10 than the miniature fuses 11. A distal end of one of the extension portions 12*c* is bent into a bent portion 12*e* and an engageable hole 12*d* is formed on the bent portion 12*e*.

Meanwhile, in one bus bar 12A, a power source connecting portion 12*f* extends from the other of the extension portions 12*c* and a bolt hole 12*g* is formed on the power source connecting portion 12*f*. The bent portion 12*e* is formed at a distal end of the other of the extension portions 12*c* and the engageable hole 12*d* is formed on the bent portion 12*e*.

On the other hand, in the other bus bar 12B, the power source connecting portion 12*f* and the bent portion 12*e* are not provided on the other of the extension portions 12*c*, while the engageable hole 12*d* is formed on the other of the extension portions 12*c*.

Figure 4:
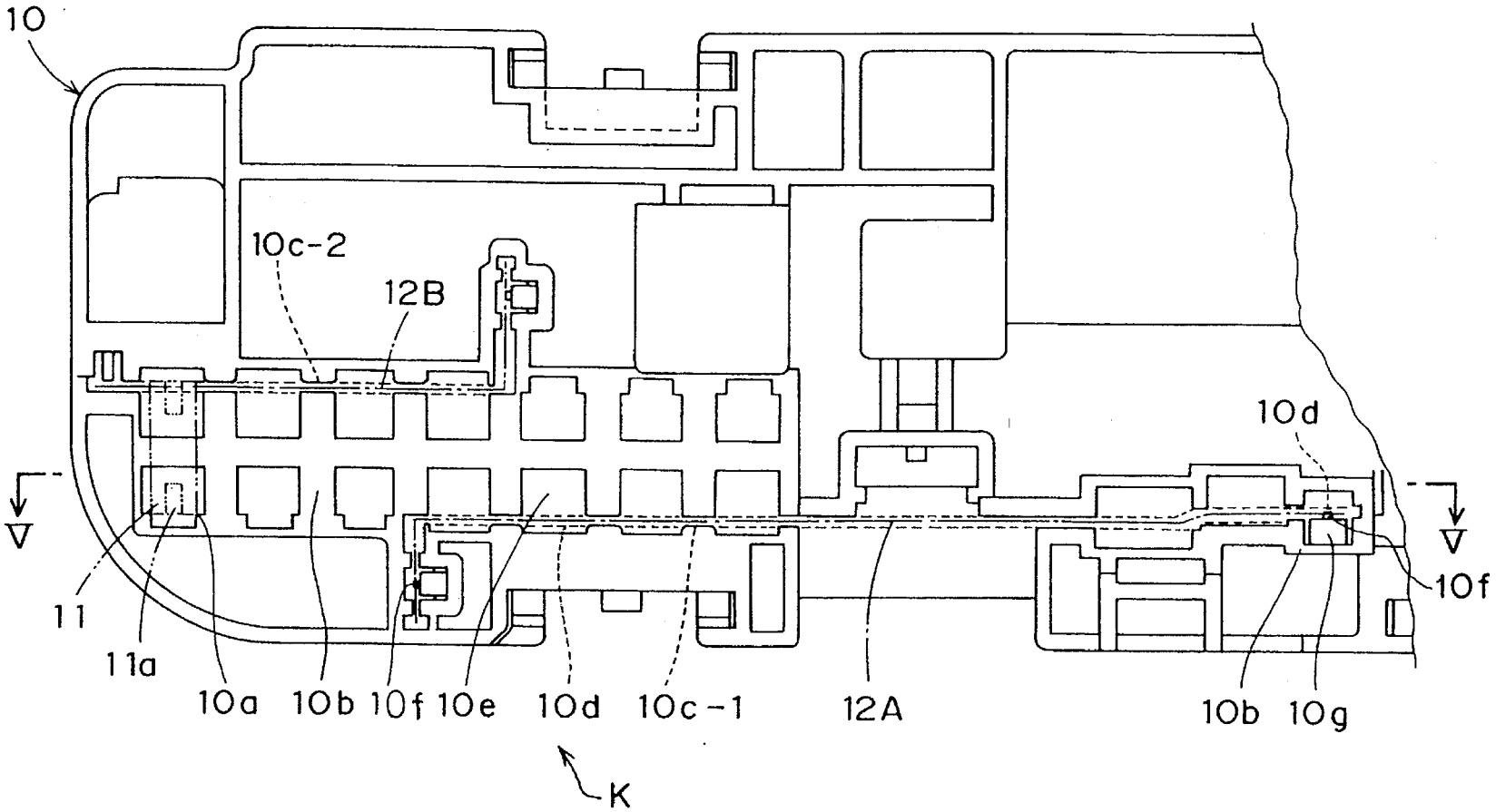
FIG. 4 is a top plan view showing a state in which the bus bars of FIGS. 2 and 3 are mounted on the electrical connection box.
Figure 5:
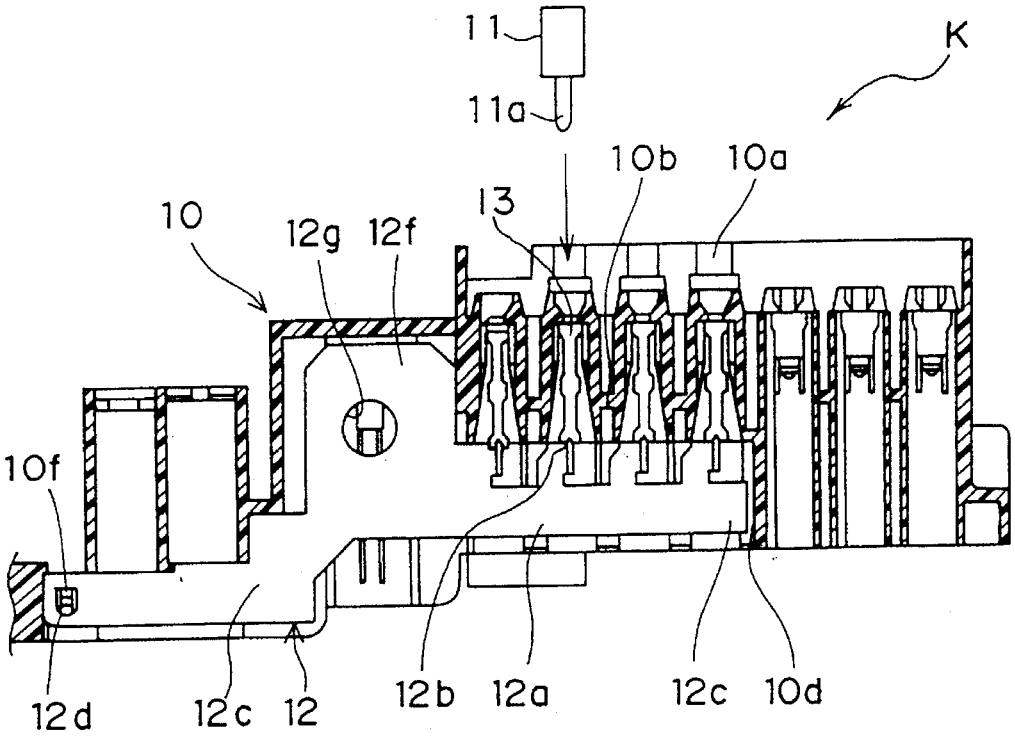
FIG. 5 is a sectional view taken along the line V—V in FIG. 4.
Figure 6:
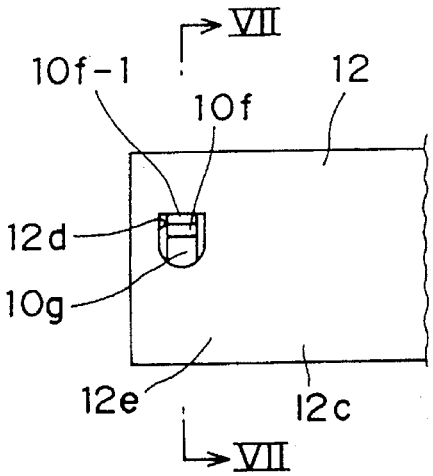
FIG. 6 is a schematic front elevational view showing a state in which the bus bars of FIGS. 2 and 3 are fixed to the electrical connection box.

As shown in FIGS. 4 and 5, the electrical connection box 10, to which the bus bar 12 and the miniature fuses 11 are attached, has two rows of the fuse receivers 10*a* which are arranged in parallel with each other at a small interval so as to be separated from each other by partition walls 10*b*. A groove 10*c*-1 for receiving the bus bar 12A vertically is formed at a lower portion of each of the fuse receivers 10*a* of one row, while a groove 10*c*-2 for receiving the bus bar 12B vertically is formed at a lower portion of each of the fuse receivers 10*a* of the other row. In these grooves 10*c*-1 and 10*c*-2, a horizontally continuously extending receiver 10*d* for receiving the base portion 12*a* and a receiver 10*e* for receiving each of the tubs 12*b* connected to the relay terminals 13 are formed continuously. Each of the terminal plates 11*a* of each of the miniature fuses 11 is inserted downwardly into the relay terminal 13 such that each of the miniature fuses 11 and the bus bar 12 are connected to each other.

The receiver 10*d* of the grooves 10*c*-1 and 10*c*-2 is adapted to receive also the extension portion 12*c* and the bent portion 12*e* disposed at the distal end of the extension portion 12*c*. Thus, a portion of the receiver 10*d*, which receives the extension portion 12*c* and the bent portion 12*e*, is formed so as not to interfere with other components as described above.

Figure 7:
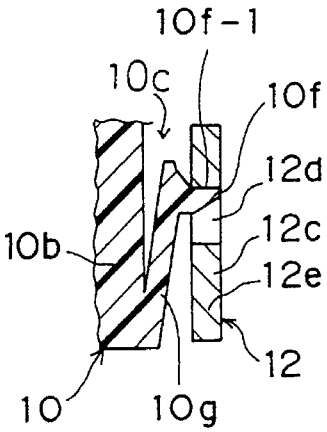
FIG. 7 is a sectional view taken along the line VII—VII in FIG. 6.

A pair of bosses 10*f* are, respectively, formed at opposite ends of each of the grooves 10*c*-1 and 10*c*-2 so as to confront the engageable holes 12*d* of the bus bar 12. More specifically, as shown in FIG. 7, an elastic piece 10*g* extends upwardly obliquely from a lower end of the partition wall 10*b* into the groove 10*c* and an upper end of the elastic piece 10*g* projects horizontally so as to integrally form the boss 10*f* having an engageable face 10*f*-1.

When the bus bar 12 is inserted into the electrical connection box 10 so as to be affixed to the electrical connection box 10, the bus bars 12A and 12B are inserted into the grooves 10*c*-1 and 10*c*-2 from below, respectively. Then, the bus bar 12 is further depressed into the grooves 10*c*-1 and 10*c*-2 by deflecting the elastic piece 10*g* towards the partition wall 10*b* such that the engageable hole 12*d* rides over the boss 10*f*. As a result, an upper end face of the engageable hole 12*d* is retained by the engageable face 10*f*-1 of the boss 10*f* such that the bus bar 12 is fixed to the electrical connection box 10.

After the bus bar 12 has been secured to the electrical connection box 10 as described above, the miniature fuse 11 is mounted in the fuse receiver 10*a of* the electrical connection box 10 from above. Thus, the terminal plate 11*a* of the miniature fuse 11 is inserted into the relay terminal 13 so as to be connected to the tab 12*b* of the bus bar 12, which has preliminarily been inserted into the relay terminal 13.

By the above described arrangement of the construction K, the engageable hole 12*d* of the bus bar 12 is spaced away from a position where the miniature fuse 11 is connected to the bus bar 12. Furthermore, the bus bar 12 is connected to the electrical connection box 10 through the engageable holes 12*d*. Accordingly, even if the temperature of the miniature fuses 11 rises, heat is conducted to the electrical connection box 10 through the bus bar 12 having large area, so that the bus bar 12 has great heat dissipation effect and thus, overheating of the electrical connection box 10 is prevented. Meanwhile, since the bus bar 12 has large area, the bus bar 12 is capable of allowing a large quantity of electric current to flow therethrough.

Figure 8:
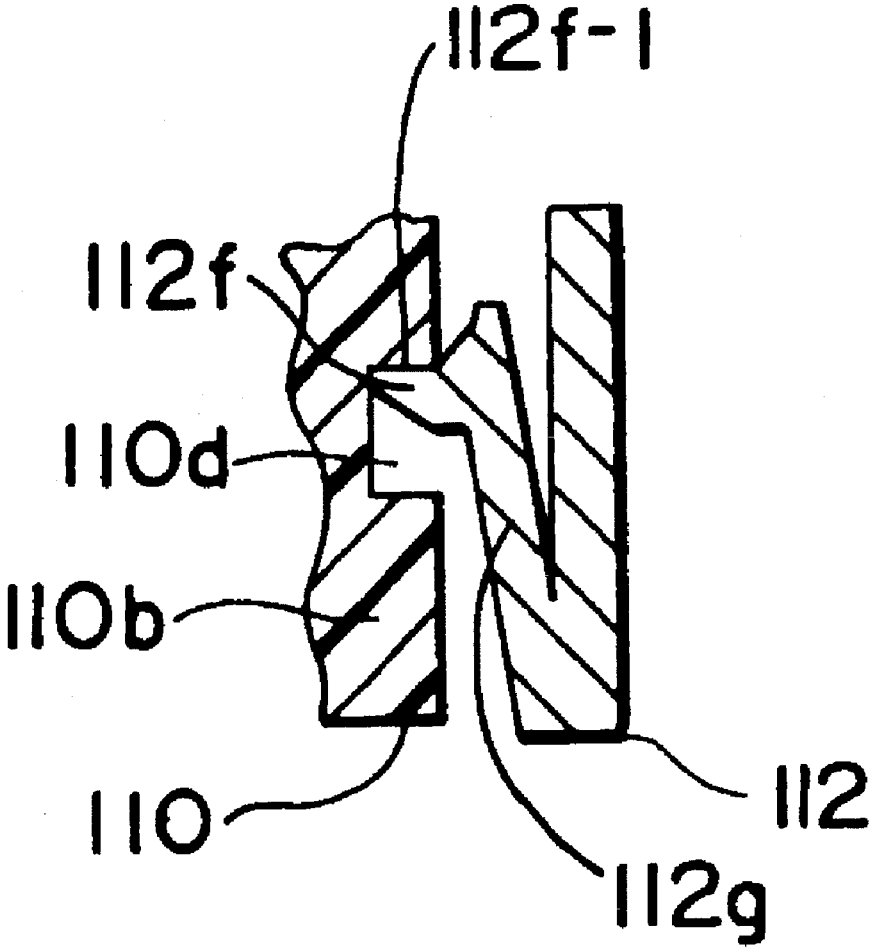
FIG. 8 is a sectional view similar to that of FIG. 7, but showing an alternate embodiment wherein the engageable portions of the bus bar are each formed by a boss, and the mating engageable portions of the electrical connection box are each formed by an engageable hole.

As shown in FIG. 8, the engageable portions of the bus bar may each be formed by a boss, in which case the mating engageable portions of the electrical connection box are each formed by an engageable hole. In such embodiments, the construction is essentially the reverse of that shown in FIG. 7. Thus, in the embodiment of FIG. 8, the bus bar 112 is provided with bosses 112*f*, which each have an engageable face, 112*f*-1. Each boss is provided at an end of an elastic piece 112*g*. The partition wall 110*b* of the electrical connection box 110 is therefore provided with the mating engageable holes 110*d*.

As is clear from the foregoing description of the construction of the present invention, the engageable portions for fixing the bus bar to the electrical connection box are provided at the opposite ends of the base portion of the bus bar, respectively. Therefore, even when the tabs for connecting the miniature fuses to the bus bar are required to be provided at a short interval, the engageable portions for fixing the bus bar to the electrical connection box can be formed easily and can be brought into engagement with the mating engageable portions of the electrical connection box efficiently.

Furthermore, since the engageable portions provided at the opposite ends of the base portion of the bus bar do not interfere with other components accommodated in the electrical connection box through effective utilization of space, the bus bar can be made large in size without the need for increasing size of the electrical connection box itself. By making the bus bar larger, resistance of the bus bar is reduced through increase of its area for passing electric current therethrough. As a result, since heat dissipation effect of the bus bar can be improved, the bus bar is suitable for its connection to the miniature fuses whose temperature readily rises.

What is claimed is:

1. A construction for fixing a bus bar for miniature fuses to an electrical connection box, wherein the miniature fuses attached to the electrical connection box in parallel with each other at a short interval are connected to the bus bar, when said bus bar is accommodated in the electrical connection box, said construction further comprising:

a base portion of the bus bar, said base portion being in a plane, tabs which project from positions on the base portion of the bus bar in parallel with each other at the short interval so as to be connected to respective miniature fuses, said tabs having a first end secured to said base portion and a second end twisted out of the plane of said base portion;

a pair of extension portions which extend from opposite ends of the base portion of the bus bar beyond the positions of the respective tabs on the bus bar;

a pair of engageable portions on the respective extension portions;

a pair of mating engageable portions being engageable with the respective engageable portions are provided on the electrical connection box;

each of the engageable portions of the bus bar comprising at least one of an engageable hole and a boss, and each of the mating engageable portions of the electrical connection box comprising the other of said engageable hole or said boss; and at least one of said extension portions extending from the opposite ends of the base portion of the bus bar comprising a bent portion having at least one of said pair of engageable portions thereon.

2. A construction as claimed in claim 1, wherein each of the engageable portions of the bus bar comprises a respective one of engageable holes, and each of the mating engageable portions of the electrical connection box comprises a respective one of the bosses.

3. A construction as claimed in claim 1, wherein each of the engageable portions of the bus bar comprises a respective one of the bosses, and each of the mating engageable portions of the electrical connection box comprises a respective one of the engageable holes.

4. A construction as claimed in claim 1, wherein each of said engageable portions is spaced away from a position where the miniature fuses are connected to said bus bar.

5. A construction as claimed in claim 4, whereby said bus bar permits the electrical current passed through said miniature fuses to pass through said bus bar, without substantially increasing the electrical resistance of the portion of the circuit contained within said bus bar.

6. A construction as claimed in claim 4, whereby heat conducted from the miniature fuses to the electrical connection box is restricted.

7. A construction as claimed in claim 4, whereby said bus bar can be affixed to the electrical connection box without the need for substantially increasing the size of the electrical connection box.

8. A construction for fixing a bus bar for miniature fuses to an electrical connection box, wherein the miniature fuses attached to the electrical connection box in parallel with each other at a short interval are connected to the bus bar, when said bus bar is accommodated in the electrical connection box, said construction further comprising:

a base portion of the bus bar, said base portion being in a plane, tabs which project from positions on the base portion of the bus bar in parallel with each other at the short interval so as to be connected to respective miniature fuses, said tabs having a first end secured to said base portion and a second end twisted out of the plane of said base portion;

a pair of extension portions which extend from opposite ends of the base portion of the bus bar beyond the positions of the respective tabs on the bus bar;

a pair of engageable portions on the respective extension portions;

a pair of mating engageable portions being engageable with the respective engageable portions are provided on the electrical connection box, each of said engageable portions being spaced away from a position where the miniature fuses are connected to said bus bar;

each of the engageable portions of the bus bar comprising at least one of an engageable hole and a boss, and each of the mating engageable portions of the electrical connection box comprising the other of said engageable hole or said boss; and at least one of said extension portions extending from the opposite ends of the base portion of the bus bar comprising a bent portion having at least one of said pair of engageable portions thereon.

9. A construction as claimed in claim 8, wherein each of the engageable portions of the bus bar comprises a respective one of the bosses, and each of the mating engageable portions of the electrical connection box comprises a respective one of the engageable holes.

10. A construction as claimed in claim 8, wherein said bus bar is arranged to permit the electrical current passed through said miniature fuses to pass through said bus bar, without substantially increasing the electrical resistance of the portion of the circuit contained within said bus bar.

11. A construction as claimed in claim 8, wherein heat conducted from the miniature fuses to the electrical connection box is restricted.

12. A construction as claimed in claim 8, wherein said bus bar is arranged to be affixed to the electrical connection box without the need for substantially increasing the size of the electrical connection box.

13. A construction as claimed in claim 8, wherein each of the engageable portions of the bus bar is formed by a respective one of the engageable holes and each of the mating engageable portions of the electrical connection box is formed by a respective one of the bosses.

* * * * *

UNITED STATES PATENT AND TRADEMARK OFFICE

CERTIFICATE OF CORRECTION

PATENT NO. : 5,474,475

DATED : December 12, 1995

INVENTOR(S) : Jun YAMAGUCHI

It is certified that error appears in the above-indentified patent and that said Letters Patent is hereby corrected as shown below:

At column 6, line 1, before "engageable" insert --- the---.

Signed and Sealed this

Eighteenth Day of February, 1997

*Attest:*

*Attesting Officer*

BRUCE LEHMAN

*Commissioner of Patents and Trademarks*